US007287507B2

(12) United States Patent
Futamura et al.

(10) Patent No.: US 7,287,507 B2
(45) Date of Patent: Oct. 30, 2007

(54) ENGINE OIL SUPPLY APPARATUS

(75) Inventors: Kazumasa Futamura, Toyota (JP); Makoto Shirai, Toyohashi (JP); Toru Fujikawa, Obu (JP); Atsutoshi Ikegawa, Nagoya (JP)

(73) Assignee: Aisin Seiki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/546,986

(22) PCT Filed: Feb. 27, 2004

(86) PCT No.: PCT/JP2004/002426

§ 371 (c)(1),
(2), (4) Date: May 11, 2006

(87) PCT Pub. No.: WO2004/076825

PCT Pub. Date: Sep. 10, 2004

(65) Prior Publication Data

US 2006/0231057 A1 Oct. 19, 2006

(30) Foreign Application Priority Data

Feb. 28, 2003 (JP) ..... 2003-054045
Mar. 17, 2003 (JP) ..... 2003-071824

(51) Int. Cl.
*F01M 1/02* (2006.01)

(52) U.S. Cl. ..... 123/196 R

(58) Field of Classification Search ..... 123/196 R, 123/196 M, 196 S
See application file for complete search history.

(56) References Cited

U.S. PATENT DOCUMENTS

| | | | | |
|---|---|---|---|---|
| 5,918,573 | A * | 7/1999 | Killion | 123/192.2 |
| 7,219,645 | B2 * | 5/2007 | Lamb et al. | 123/196 R |
| 2007/0000470 | A1 * | 1/2007 | Lamb et al. | 123/196 R |

FOREIGN PATENT DOCUMENTS

| | | |
|---|---|---|
| JP | 58-018008 | 7/1981 |
| JP | 57-200607 | 12/1982 |
| JP | 62-195613 | 2/1986 |
| JP | 63-12606 | 7/1986 |
| JP | 63-012606 | 7/1986 |
| JP | 63-126508 | 11/1986 |
| JP | 63-126508 | 2/1987 |
| JP | 57-200607 | 6/1989 |
| JP | 3023803 | 12/1990 |
| JP | 4-132414 | 5/1991 |
| JP | 10-252434 | 3/1997 |
| JP | 2001-241313 | 2/2000 |
| JP | 2003-336513 | 5/2003 |

OTHER PUBLICATIONS

International Search Report of PCT/JP2004/002426 dated Jun. 29, 2004.
PCT International Preliminary Report of PCT/JP2004/002426, Nov. 17, 2005.

* cited by examiner

*Primary Examiner*—Stephen K. Cronin
*Assistant Examiner*—Jason Benton
(74) *Attorney, Agent, or Firm*—Reed Smith LLP; Stanley P. Fisher, Esq.; Juan Carlos A. Marquez, Esq.

(57) ABSTRACT

In order to provide an engine oil supply apparatus including a second oil pump (12) which can draw in and discharge oil quickly regardless of whether or not a first oil pump (11) is driven and which does not need to be large, an engine oil supply apparatus (Y) includes a first oil pump (11) drawing oil through a first oil passage (21) from an oil holder (13) holding oil, a second oil pump (12) connected in series with the first oil pump (11) through a connection oil passage (26) and driven independently of the first oil pump (11), a first supply oil passage (23) for supplying oil to a first circulation section (41) from the first oil pump (11), and a second supply oil passage (24) for supplying oil to a second circulation section (42) from the second oil pump (12). In the engine oil supply apparatus (Y), a first oil reservoir (15) holds oil to be supplied to the second oil pump (12) and is provided independently of the oil holder (13) is provided.

11 Claims, 7 Drawing Sheets

ENGINE OIL SUPPLY APPARATUS

TECHNICAL FIELD

The present invention relates to an engine oil supply apparatus comprising a first oil pump driven in synchronism with a crank shaft and drawing oil through a first oil passage from an oil holder holding the oil, a second oil pump connected in series with the first oil pump through a connection oil passage and driven independently of the first oil pump, a first supply oil passage for supplying the oil from the first oil pump to a first circulation section, and a second supply oil passage for supplying the oil from the second oil pump to a second circulation section.

BACKGROUND ART

Conventionally, a known structure of such an engine oil supply apparatus comprises a first oil pump for pumping up hydraulic oil from an oil pan and a second oil pump for pumping up hydraulic oil from an oil bath. In the known structure, an oil feeding path communicating a hydraulic oil consumption section with the first oil pump is connected therebetween, a valve system lubrication branching oil passage communicating with each lubrication section of a valve system is branched from the oil feeding path. The oil bath is capable of receiving any oil that has leaked from the lubrication sections and allows any excess oil to overflow to the oil pan (See, for example, Patent Document 1: Japanese Patent No. 3023803 (paragraph number 0033)).

In addition, the second oil pump for pumping up hydraulic oil from the oil bath is connected to a hydraulic chamber of valve operation characteristic changing means.

Accordingly, it is possible to reduce an increase in friction loss during high-speed rotation of an engine by setting the volume of the second oil pump so as to have no relationship with the amount of oil required at the lubrication sections. In addition, maintenance can be simplified by connecting the oil bath and the oil pan.

Another type of oil supply apparatus has also been available. This engine supplier comprises a first oil pump serving as a main pump in a control hydraulic circuit of an engine driving mechanism, a second oil pump serving as a sub-pump which is different from the first oil pump and disposed in parallel, and a switching mechanism for switching between oil passages of both of the oil pumps depending upon the driving state of the engine. (See, for example, Patent Document 2: Japanese Unexamined Utility Model Registration Application Publication No. 4-132414 (paragraph numbers 0006 to 0009).

Accordingly, for example, when the engine is rotating at a low speed and is subjected to a high load, it is possible to connect the second oil pump to the control hydraulic circuit and disconnect the first oil pump from the control hydraulic circuit by the switching mechanism. Therefore, since a sufficient hydraulic oil pressure in accordance with a required amount is quickly supplied from the second oil pump (not used for, for example, lubrication) to a phase changing mechanism used for changing the relative rotational phases of a cam shaft and a sprocket, the operation speed of the phase changing mechanism is high.

Patent Document 2 also discloses an engine oil supply apparatus comprising a second oil pump disposed in series in a control oil passage circuit of the driving mechanism in order to increase the discharging capability of the first oil pump. Accordingly, for example, when the engine is rotating at a low speed and is subjected to a high load, the hydraulic oil which is discharged from the first oil pump and which has a portion sent under pressure to the control hydraulic circuit has its discharge pressure further increased by the second oil pump. Therefore, since a sufficient hydraulic oil pressure in accordance with a required amount is quickly provided at the phase changing mechanism, the operating speed of the phase changing mechanism is high.

Ordinarily, oil at any portion of the engine requiring lubrication returns to an oil holder for holding oil, such as an oil pan, through gaps between engine members prior to starting the engine. Therefore, prior to the starting of the engine, the oil pumps and oil passages are not filled with oil, and, thus, a certain amount of air exists. Consequently, after starting the engine, it is necessary to supply oil as quickly as possible to the oil pumps and the oil passages and to supply oil to any parts of the engine requiring lubrication in order to reduce friction at sliding sections and to thus achieve smooth movement.

Accordingly, since it is necessary for the first and second oil pumps to supply oil to any portion of the engine requiring lubrication in a short time while removing air from the oil passages, it is desirable for the oil pumps to be strong. In particular, the second oil pump forcefully draws in oil from the oil holder through a slight gap in the first oil pump when, for example, the crank shaft is driven due to the starting of the engine. This causes the second oil pump to have a larger size. Ordinarily, since the second oil pump is disposed at the control hydraulic circuit of the engine driving mechanism, it is not desirable for the second oil pump to be large.

Further, in the structure of Patent Document 2 in which the first oil pump and the second oil pump which increases the discharge pressure of the first oil pump are disposed in series, the second oil pump draws in the oil drawn in by and discharged from the first oil pump. Therefore, the suction of the oil by the second oil pump requires suction and discharging of oil by the driving of the first oil pump. This results in the problem that the second oil pump cannot draw in oil unless the first oil pump is driven and discharges oil. As a result, smooth movement may not be achieved for some time after the driving of the first oil pump at, for example, the sliding sections of the engine to which oil is supplied from the second pump.

Accordingly, it is an object of the present invention to provide an engine oil supply apparatus comprising a second oil pump which can draw in and discharge oil quickly regardless of whether or not a first oil pump is driven and which can increase the discharge pressure of the first oil pump without increasing the size of the second oil pump.

DISCLOSURE OF INVENTION (First Characteristic Structure)

In the first characteristic structure according to the present invention, an engine oil supply apparatus comprises a first oil pump driven in synchronism with a crank shaft and drawing oil through a first oil passage from an oil holder holding the oil, a second oil pump connected in series with the first oil pump through a connection oil passage and driven independently of the first oil pump, a first supply oil passage for supplying the oil to a first circulation section from the first oil pump, and a second supply oil passage for supplying the oil to a second circulation section from the second oil pump. In the engine oil supply apparatus, a first oil reservoir which holds the oil to be supplied to the second oil pump is provided. The first oil reservoir is shielded from the outside, and is independent of the oil holder is provided.

(Operational Advantages)

With this structure, by disposing the first oil reservoir holding oil to be supplied to the second oil pump independently of the oil holder, when, for example, the engine is started, the first oil pump draws in oil from the oil holder and the second oil pump draws in oil from the first oil reservoir independently. Accordingly, the second oil pump can draw in oil regardless of whether or not the first oil pump is driven.

Therefore, before or immediately after the engine is started, or when the discharge pressure of the first oil pump is low, etc., oil is directly supplied to the second circulation section from the second oil pump. In other words, by virtue of this structure, oil is quickly supplied to any parts of the engine requiring lubrication before and after the starting of the engine.

When oil is quickly supplied to the second circulation section, so that oil is quickly supplied to, for example, a VVT (valve opening/closing time controller or a variable valve timing mechanism) or a chain tensioner, NV (noise vibration) occurring when the engine is started can be reduced. In addition, when oil is quickly supplied to the VVT, control response is improved when, for example, ecology-friendly driving mode (that is, energy saving driving, such as stopping the engine, when, for example, waiting for a signal to change) is started.

If the second circulation section is an HLA (hydraulic lash adjuster), since the gaps between the valves and cams of the engine is automatically adjusted, the movement of the valves is stabilized from the starting of the engine. An HLA is a hydraulic mechanism for eliminating clearances between cams for pushing suction-and-exhaust valves and a shaft of the suction-and-exhaust valves.

Since oil can be drawn in by the second oil pump from the oil holder, the second oil pump does not need to draw in the oil through the first oil pump, for example, before or immediately after starting the engine, or when a discharge pressure of the first oil pump is low. Therefore, it is no longer necessary for the second oil pump to forcefully draw in the oil from the oil holder through the slight gap in the first oil pump as a conventional oil pump did, thereby making it unnecessary to use a large second oil pump.

Further, with the present structure, the first oil reservoir is shielded from the outside. Therefore, the discharge pressure of the first oil pump can be increased by the second oil pump as a result of the second oil pump drawing in and discharging oil that is in turn drawn in by and discharged by the first oil pump.

Since the first oil reservoir is an oil reservoir designed specifically for supplying oil to the second oil pump, the volume of the oil holder can be correspondingly reduced. Therefore, since the engine can be designed with greater freedom, an engine that is easily designed can be provided.

(Second Characteristic Structure)

In the engine oil supply apparatus according to the present invention, the oil may be supplied from the oil holder or a second oil reservoir to the second oil pump through a second oil passage of the connection oil passage, and a first valve for controlling circulation of the oil to the second oil pump may be disposed in the second oil passage.

(Operational Advantages)

Accordingly, when the engine oil supply apparatus has a structure in which oil is supplied to the second oil pump from the oil holder or the second oil reservoir through the second oil passage, the second oil pump can reliably draw in the oil stored in the second oil reservoir when the second oil pump is driven.

In addition, with a first valve provided in the second oil passage to control the circulation of the oil from the second oil passage to the second oil pump, the second oil pump can draw in oil only from the second oil reservoir by opening the first valve when only the second oil pump is driven.

(Third Characteristic Structure)

In the engine oil supply apparatus according to the present invention, the first valve may be a check valve or a control valve.

(Operational Advantages)

For example, when the first valve is a check value, costs can be reduced because a valve having a simple structure, such as a spring structure, is used. In addition, since it does not particularly need to be controlled with, for example, a controller, it does not need to be connected with the controller, so that the structure of the oil supply apparatus is simplified.

On the other hand, if the first valve is a control valve, it can be opened and closed at any pressure by controlling it with, for example, a controller, so that the flow amount can be adjusted. This makes it possible to set an optimum quantity of flow of oil in accordance with the driving state of the engine. In addition, since a spring structure is not used, there is no pressure loss in the quantity of flow resulting from spring pressure.

(Fourth Characteristic Structure)

In the engine oil supply apparatus according to the present invention, a third oil passage for supplying the oil to the second supply oil passage by bypassing the second oil pump may be provided, and a second valve for controlling circulation of the oil to the second supply oil passage may be disposed in the third oil passage.

(Operational Advantages)

In other words, by providing a third oil passage for supplying oil to the second supply oil passage by bypassing the second oil pump, even after the second oil pump has been stopped, the oil can be supplied to the second circulation section, disposed downstream from the second oil pump, via the third oil passage. Therefore, since, for example, after starting the engine, the engine oil supply apparatus can be operated while the second oil pump is stopped, it is possible to save the energy used for the power of the second oil pump, so that the drive power of the engine can be reduced.

Since a second valve is disposed in the third oil passage, it is possible to prevent reverse flow of the oil and to control the circulation of the oil in accordance with the discharge pressure of the oil from the first oil pump. For example, if the second oil pump is no longer needed because the pressure of the first oil pump is sufficiently high, opening the second valve makes it possible to supply oil to the second circulation section while it bypasses the second oil pump.

(Fifth Characteristic Structure)

In the engine oil supply apparatus according to the present invention, the second valve may be a check valve or a control valve.

(Operational Advantages)

For example, if the second valve is a check value, costs can be reduced because a valve having a simple structure, such as a spring structure, is used. In addition, since it does not need to be controlled with, for example, an electronic centralized controller, it does not need to be connected with the electronic centralized controller, so that the structure of the oil supply apparatus is simplified.

On the other hand, if the second valve is a control valve, it can be opened and closed at any pressure by controlling it with, for example, a controller, so that the flow amount can be adjusted. This makes it possible to set an optimum quantity of flow of oil in accordance with the driving state of the engine. In addition, since a spring structure is not used, there is no pressure loss in the quantity of flow resulting from spring pressure.

The pressure of the first oil pump may vary in various ways in accordance with the driving state of the engine. Here, the amount of discharge of oil from the first oil pump also varies in various ways. In such a case, if the opening is adjusted with the second valve, which is a control valve, in accordance with the condition, it is possible to control the quantity of flow of the oil in accordance with the discharge pressure (discharge amount) of the oil from the first oil pump.

(Sixth Characteristic Structure)

In the engine oil supply apparatus according to the present invention, a reflux oil passage in which oil flows back from the first circulation section or the second circulation section is connected to and disposed at the second oil reservoir.

(Operational Advantages)

In other words, if a reflux oil passage in which oil flows back from the first circulation section or the second circulation section is connected to the second oil reservoir, it is possible to efficiently and temporarily re-store oil that has been supplied to each section.

Since the oil which flows back from the circulation section is stored in the second oil reservoir, the oil flows back at all times during the driving of the engine, so that the second oil reservoir can be filled with the oil at all times. Therefore, the second oil pump can reliably draw in the oil from the second oil reservoir.

(Seventh Characteristic Structure)

In the engine oil supply apparatus according to the present invention, a third supply oil passage for supplying oil discharged from the first oil pump may be connected to the first oil reservoir.

(Operational Advantages)

In other words, if a third supply oil passage for supplying oil discharged from the first oil pump is connected to the first oil reservoir, the first oil reservoir can store the oil via the third supply oil passage. Accordingly, by providing an additional third supply oil passage in addition to the connection oil passage, the first oil reservoir can store the oil more efficiently.

(Eighth Characteristic Structure)

In the engine oil supply apparatus according to the present invention, an oil filter may be disposed in the connection oil passage and may function as the first oil reservoir.

(Operational Advantage)

By disposing an oil filter in the connection oil passage and using the oil filter as the first oil reservoir, the oil filter which ordinarily stores a constant amount of oil can be effectively used. Therefore, the capability of supplying oil to the second oil pump can be enhanced without considerably changing the structure of the engine. In addition, since the oil filter functions as the first oil reservoir, the space where the first oil reservoir would have been located can be reduced in size, so that the engine can be made compact.

(Ninth Characteristic Structure)

In the engine oil supply apparatus according to the present invention, the connection oil passage and the first oil reservoir may be integrally formed with a member of the engine.

(Operational Advantages)

In other words, if the connection oil passage and the first oil reservoir are integrally formed with a member of the engine, the length of the connection oil passage connecting the first oil pump and the second oil pump and the length of the second oil passage connecting the first oil reservoir and the second oil pump can be reduced.

Therefore, oil can be quickly circulated by reducing the lengths of the oil passages connecting the respective members. In addition, since oil lubrication paths become shorter, oil pressure loss occurring when, for example, the engine is started can be reduced.

Since, when mounting the connection oil passage and the first oil reservoir in the engine, only a member of the engine with which they are integrally formed needs to be mounted, they are less troublesome to mount, so that the assembly of the engine can be made more efficient.

(Tenth Characteristic Structure)

In the engine oil supply apparatus according to the present invention, a third valve for performing a controlling operation so that only the oil from the second oil passage can be supplied to the second oil pump may be disposed in the connection oil passage.

(Operational Advantages)

Ordinarily, after the engine has stopped, oil circulating in the oil supply apparatus flows back to the oil holder through gaps between members of an engine. Therefore, immediately after the engine is started, the first oil pump and the connection oil passage, disposed downstream from the first oil pump, are not filled with oil, so that a certain amount of air exists therein. If the engine is started in this state and the second oil pump is driven, the second oil pump may draw in the air. In order to avoid this, a third valve which performs a control operation so that only oil from the second oil passage can be supplied to the second oil pump is provided.

By virtue of such a structure, it is possible to prevent the air existing in a path upstream from the second oil pump from being drawn in. Therefore, it is possible to effectively prevent the occurrence of problems such as a lack of lubricating oil in, for example, the second circulation section. In addition, since it is possible to prevent reverse flow of oil to the path upstream from the second oil pump, it is possible to smoothen the circulation of oil in the oil supply apparatus.

(Eleventh Characteristic Structure)

An engine oil supply apparatus according to the present invention comprises a first oil pump driven in synchronism with a crank shaft and drawing oil through a first oil passage from an oil holder holding the oil, a second oil pump provided in parallel with the first oil pump and driven independently of the first oil pump, a first supply oil passage for supplying the oil to a first circulation section from the first oil pump, and a second supply oil passage for supplying the oil to a second circulation section from the second oil pump. In the engine oil supply apparatus, oil is supplied to the second oil pump through the second oil passage, and the second oil passage is disposed independently of a first oil passage for supplying the oil to the first oil pump.

(Operational Advantages)

As in this structure, with oil being supplied to the second oil pump through the second oil passage, and with the first oil reservoir holding oil to be supplied to the second oil pump being disposed independently of the oil holder, the second oil pump can reliably draw in oil through the second oil passage. Accordingly, when the first oil reservoir specifically provided for the second oil pump is provided, if the second oil pump is driven, the second oil pump can draw in oil from the first oil reservoir. Therefore, the second oil pump can draw in oil regardless of whether or not the first oil pump is driven.

Consequently, before or immediately after the engine is started, or when the discharge pressure of the first oil pump is low, etc., the second oil pump directly supplies oil to the second circulation section to which the oil is supplied from the second oil pump. In other words, by virtue of this structure, the oil is quickly supplied to any parts of the engine requiring lubrication before and after the starting of the engine.

With this structure, since the first oil pump and the second oil pump are connected in parallel, the second oil pump does not need to draw in oil through the first oil pump. Therefore, it is no longer necessary for the second oil pump to forcefully draw in oil from the oil holder through a slight gap in the first oil pump as a conventional oil pump did, thereby making it unnecessary to use a large second oil pump.

BEST MODE FOR CARRYING OUT THE INVENTION

Embodiments of the present invention will hereunder be described with reference to the drawings.

FIRST EMBODIMENT

Figure 1:
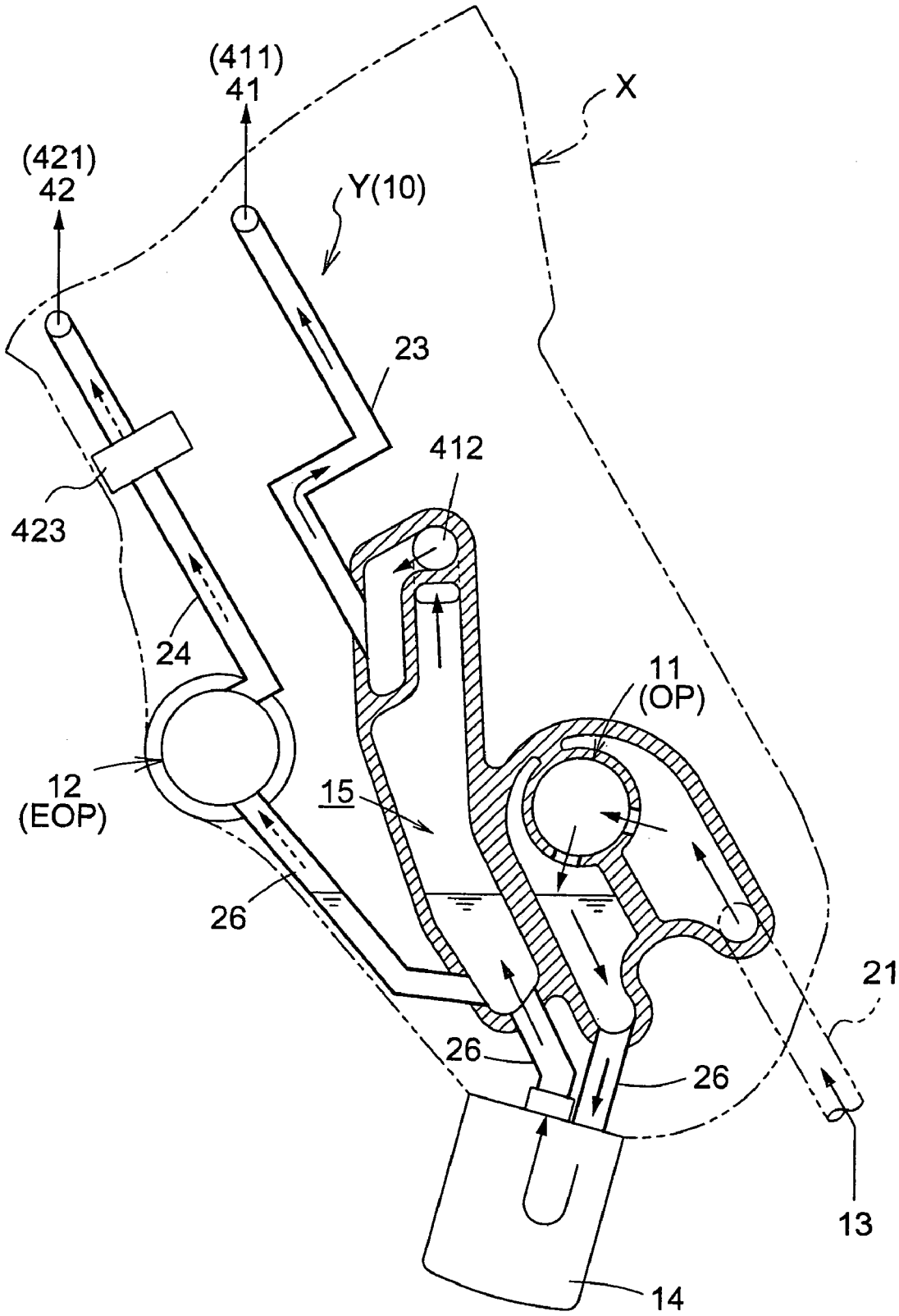
FIG. 1 is a side view of an oil supply apparatus according to a first embodiment.
Figure 5:
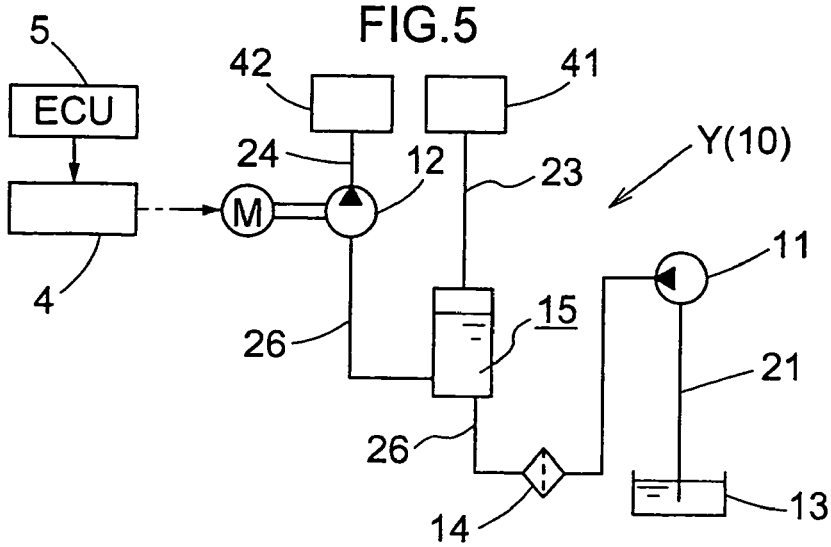
FIG. 5 is a schematic view of the oil supply apparatus according to the first embodiment.

FIG. 1 schematically shows an oil supply apparatus Y of the present invention viewed from a side of an engine X. FIG. 5 schematically shows oil supply paths in a control hydraulic circuit 10 of the oil supply apparatus Y.

The control hydraulic circuit 10 includes, for example, oil pumps for supplying oil to any portion in an engine requiring lubrication, oil passages for circulating the oil, valves for controlling the circulation of the oil, etc. An oil holder 13 holds the oil.

In the present invention, the oil pumps are a first oil pump 11 driven in synchronism with a crankshaft and a second oil pump 12 connected in series with the first oil pump 11 and driven independently of the first oil pump 11. These oil pumps may be, for example, mechanical oil pumps or electrically driven oil pumps.

Hereunder, a mechanical oil pump (OP) is used as the first oil pump 11 and an electrically driven oil pump (EOP) is used as the second oil pump 12.

The first oil pump 11 is connected to a first oil passage 21 for drawing in oil from the oil holder 13. The drawn oil is discharged from the first oil pump 11 and passes through an oil filter 14. Thereafter, a portion of the oil flows into a main gallery 412 and a portion of the oil is supplied to a lubrication system (first circulation section 41), such as a cylinder head 411, through a first supply oil passage 23.

Further, a portion of the oil discharged from the first oil pump 11 flows into the second oil pump 12 through a connection oil passage 26. Accordingly, the oil discharged from the first oil pump 11 and flown into the second oil pump 12 has its discharge pressure increased by the second oil pump 12, and is supplied to a second circulation section 42, such as a valve opening/closing time controller or a variable valve timing mechanism (VVT) 421, through a second supply oil passage 24 and a chain tensioner 423.

The control hydraulic circuit 10 is connected to an electronic centralized controller (ECU) 5 that senses the rotational speed of the engine, an engine load signal, and an engine oil temperature or water temperature detection and that outputs a control signal. The control signal from the ECU 5 is transmitted to a motor through a driver 4, and the motor drives the second oil pump 12.

As shown in FIG. 1, in the embodiment, the oil which has been discharged from the first oil pump 11 and which has passed through the oil filter 14 is guided to a first oil reservoir 15. When the engine is driven, the first oil reservoir 15 is filled with the oil, and the oil drawn in by and discharged from the first oil pump 11 is supplied to the first circulation section 41. In addition, the oil drawn in by and discharged from the second oil pump 12 is supplied to the second circulation section 42. However, for example, when the engine is not operating, as shown in FIG. 1, a constant amount of oil is held.

The first oil pump 11 is disposed upstream of the first oil reservoir 15 and the main gallery 412 and the second oil pump 12 are disposed downstream from the first oil reservoir 15. The first oil reservoir 15 is shielded from the outside. In particular, it is structurally independent of the oil holder 13. The first oil reservoir 15 is filled with the oil discharged from the first oil pump 11 and the discharge pressure of the first oil pump 11 is maintained there. The second oil pump 12 can supply oil to the second circulation section 42 after increasing supply pressure from the discharge pressure of the first oil pump 11.

Accordingly, by disposing the first oil reservoir 15, provided specifically for supplying the oil to the second oil pump 12, independently of the oil holder 13, the first oil pump 11 can draw in the oil from the oil holder 13 when starting the first oil pump 11. When starting the second oil pump 12, oil can be drawn in from the first oil reservoir 15.

Accordingly, in this structure, the second oil pump 12 can draw in oil independently of the first oil pump 11 regardless of whether or not the first oil pump 11 is being driven.

Obviously, in a normal engine start-up, the first oil pump 11 and the second oil pump 12 are driven at the same time. In this case, since the first oil pump 11 can draw in oil from the oil holder 13 and the second oil pump 12 can draw in oil from the first oil reservoir 15, the oil can be quickly supplied to the first circulation section 41 and the second circulation section 42 at substantially the same time.

Further, it is possible to drive the second oil pump 12 before driving the first oil pump 11, that is, before starting the engine. Accordingly, whereas, in a conventional driving operation, the oil supply by the first oil pump 11 is performed first, in the present embodiment, the oil supply by the second oil pump 12 can be started first.

Therefore, before the engine is started, immediately after the engine is started, or when the discharge pressure of the first oil pump 11 is low, etc., oil is directly supplied from the second oil pump 12 to the second circulation section 42, such as a hydraulic system and the VVT 421, to which the oil is supplied from the second oil pump 12. In other words, this structure allows the oil to be quickly supplied to any portion of the engine requiring lubrication before and after the engine is started.

When the oil is quickly supplied to the second circulation section 42, for example, the driving of mechanisms, such as the VVT 421 and the chain tensioner 423, can be started early, so that noise vibration (NV) occurring when the engine is started can be reduced. In addition, since oil is quickly supplied to the VVT 421, the control response when, for example, the engine is started can be improved in, for example, an ecology-friendly driving mode for controlling the driving of the engine such that the engine is stopped when the vehicle is at rest. Therefore, the VVT 421 is reliably operated. Further, if the second circulation section 42 is an HLA (hydraulic lash adjuster) which can automatically adjust a gap between a valve and a cam of the engine, the movement of the valve can be stabilized from the start of the engine.

Since the first oil reservoir 15 is an oil reservoir designed specially for supplying oil to the second oil pump 12, the volume of the oil holder 13 can be correspondingly reduced.

It is desirable that the volume of the first oil reservoir 15 be large enough for it to store the minimum amount of oil which is circulated to any portion of the engine requiring lubrication when, for example, the engine is started. More specifically, although it may be approximately 5 to 20 mL, it may have other various values in accordance with, for example, the size of the engine.

Concerning the specific shape of the first oil reservoir 15, a portion of oil passage larger than the oil passage diameter can be provided to the oil passage 26 as shown, for example, in FIG. 1 and oil can be stored in that portion. Here, the first oil reservoir 15 is at about the same height as the first oil pump 11. Such a structure can make it difficult for the oil to flow back to the oil holder 13 after the first oil pump 11 is stopped.

SECOND EMBODIMENT

Figure 2:
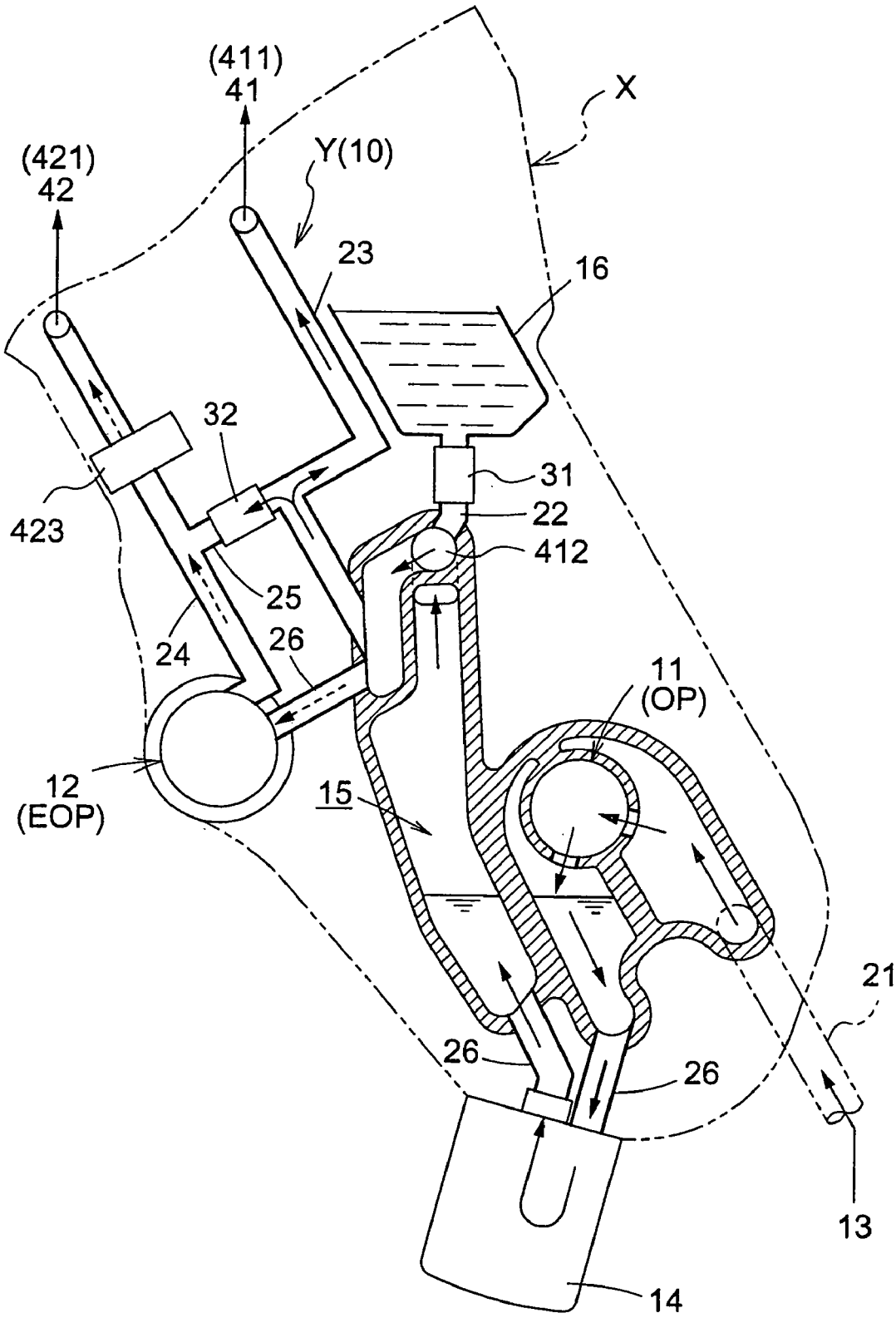
FIG. 2 is a side view of an oil supply apparatus according to a second embodiment.
Figure 6:
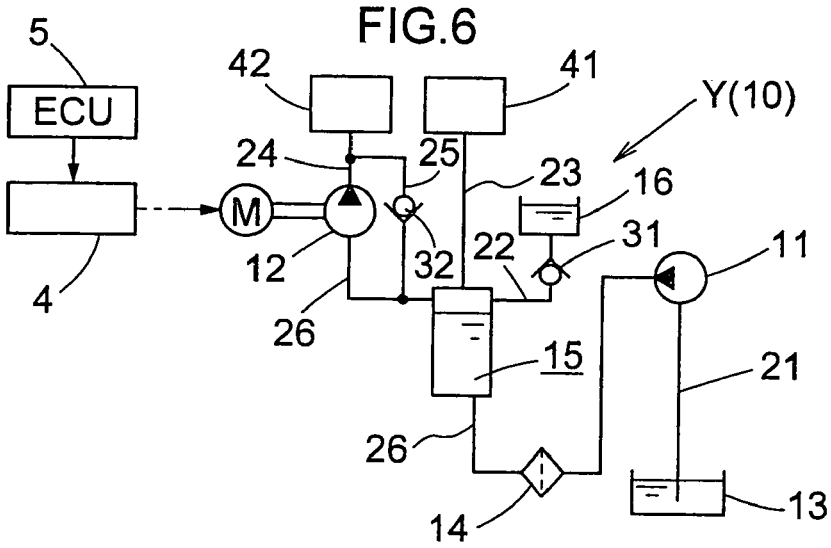
FIG. 6 is a schematic view of the oil supply apparatus according to the second embodiment.

In the present invention, as shown in FIGS. 2 and 6, a second oil reservoir 16 may be disposed independently of the first oil reservoir 15.

In this case, the second oil reservoir 16 can be disposed at a height that is higher than that at which the oil holder 13 is disposed. For example, oil is supplied to the second oil pump 12 from the second oil reservoir 16 through a second oil passage 22, communicating with the main gallery 412 from the second oil pump 16, and through the connection oil passage 26 connected to the second oil pump 12.

The location where the second oil reservoir 16 is disposed is not particularly limited, so that it may be disposed at any location. Therefore, the engine can be designed with sufficient freedom. In the present embodiment, as described above, the second oil reservoir 16 is disposed at a high position. The oil stored in the second oil reservoir 16 has potential energy with respect to the second oil pump 12. Therefore, for example, when the engine is started to start the driving of the second oil pump 12, oil can be quickly supplied to the second oil pump 12.

Of these, the second oil passage 22 has a first valve 31 for controlling the circulation of the oil to the second oil pump 12. For example, when the second pump 12 alone is driven when the engine is started, the first valve 31 is opened. Therefore, even if the first oil pump 11 is not driven, the second oil pump 12 can draw in the oil from the second oil reservoir 16. When one wants to quickly supply a large amount of oil to the second oil pump 12, the first valve 31 can be opened to a greater extent.

The first valve 31 prevents reverse flow of the oil from the second oil pump 12 to the second oil reservoir 16, and prevents the amount of oil supplied to the second oil pump 12 from being reduced.

Immediately after the engine is started, the first oil pump 11 is not filled with oil. Therefore, a certain amount of air exists in the first oil pump 11. Consequently, if the second oil pump 12 is driven immediately after the engine is started, the second oil pump 12 may draw in the air. For example, when the air is sent to the downstream circulation sections, such as the second circulation section 42, lubrication action may be adversely affected or the rotation of the engine may become irregular.

However, if, as in this structure, oil can be supplied to the second oil pump 12 through the second oil passage 22, only the oil can be supplied to the second oil pump 12 by opening the first valve 31 when the second oil pump 12 tries to draw in the air from the first oil pump 11.

The first valve 31 may be a check valve or a control valve.

Of these, the check valve is a valve which can prevent reverse flow by using a simple structure such as a spring structure. When the check valve is used, the opening and closing of the valve can be controlled by the oil pressure exerted upon the check valve. This makes it possible to control the circulation of the oil to the second oil pump 12.

Since the check valve has a simple structure, the oil supply apparatus can be reduced in cost. In addition, it no longer needs to be, for example, connected to the ECU, so that the structure of the control hydraulic circuit 10 can be simplified.

On the other hand, if a control valve is used, it can be freely opened and closed by any pressure by the controlling operation of the ECU, so that the circulation of the oil to the second oil pump 12 can be adjusted. In other words, not only the opening and closing of the valve, but also the amount of opening of the valve can be adjusted. Therefore, the quantity of flow of oil can be adjusted. In addition, since the aforementioned spring structure is not used, pressure loss in the quantity of flow due to spring pressure does not occur.

The first valve 31 may be any other known valve.

The first valve 31 may be disposed not only above the surface of the oil stored in the first oil reservoir 15, but also below the surface of the stored oil. In this case, the first valve 31 has good sealing property because it is immersed in the oil. Therefore, it is possible to prevent any air from entering the first valve 31.

As shown in FIGS. 2 and 6, in the present embodiment, a third oil passage 25 for supplying oil to the second supply oil passage 24 from the second oil passage 22 by bypassing the second oil pump 12 may be provided. A second valve 32 for controlling the circulation of the oil to the second supply oil passage 24 is disposed in the third oil passage 25.

By providing the third oil passage 25, even after the second oil pump 12 has been stopped, oil can be supplied to the second circulation section 42, disposed downstream from the second oil pump 12, through the second supply oil passage 24. This structure makes it possible to stop only the second oil pump 12, for example, after starting the engine. Therefore, energy used for providing power to the second oil pump 12 can be saved, so that the driving efficiency of the engine can be improved.

The second valve 32 disposed at the third oil passage 25 prevents reverse flow of the oil towards the second oil passage 22.

The circulation of the oil from the first oil pump 11 can be controlled based on the discharge pressure of the oil. For example, when the pressure of the first oil pump 11 becomes sufficiently high and it is no longer necessary to discharge any oil from the second oil pump 12, opening the second valve 32 allows a sufficient amount of oil to bypass the second oil pump 12 by flowing through the third oil passage 25 and to be supplied to the second circulation section.

As in the embodiment described previously, the second valve 32 may be, for example, a check valve or a control value.

When the second valve 32 is a control valve, the amount of circulation of the oil can be controlled in accordance with the driving state of the engine. In other words, when the pressure of the first oil pump 11 varies depending on the driving state of the engine, the discharge amount of the oil from the first oil pump 11 also changes. In such a case, if the amount of opening of the second valve 32, which is a control valve, is properly adjusted with, for example, the ECU 5, the amount of circulation of the oil can be adjusted in accordance with the discharge pressure (discharge amount) of the oil from the first oil pump 11.

THIRD EMBODIMENT

Figure 3:
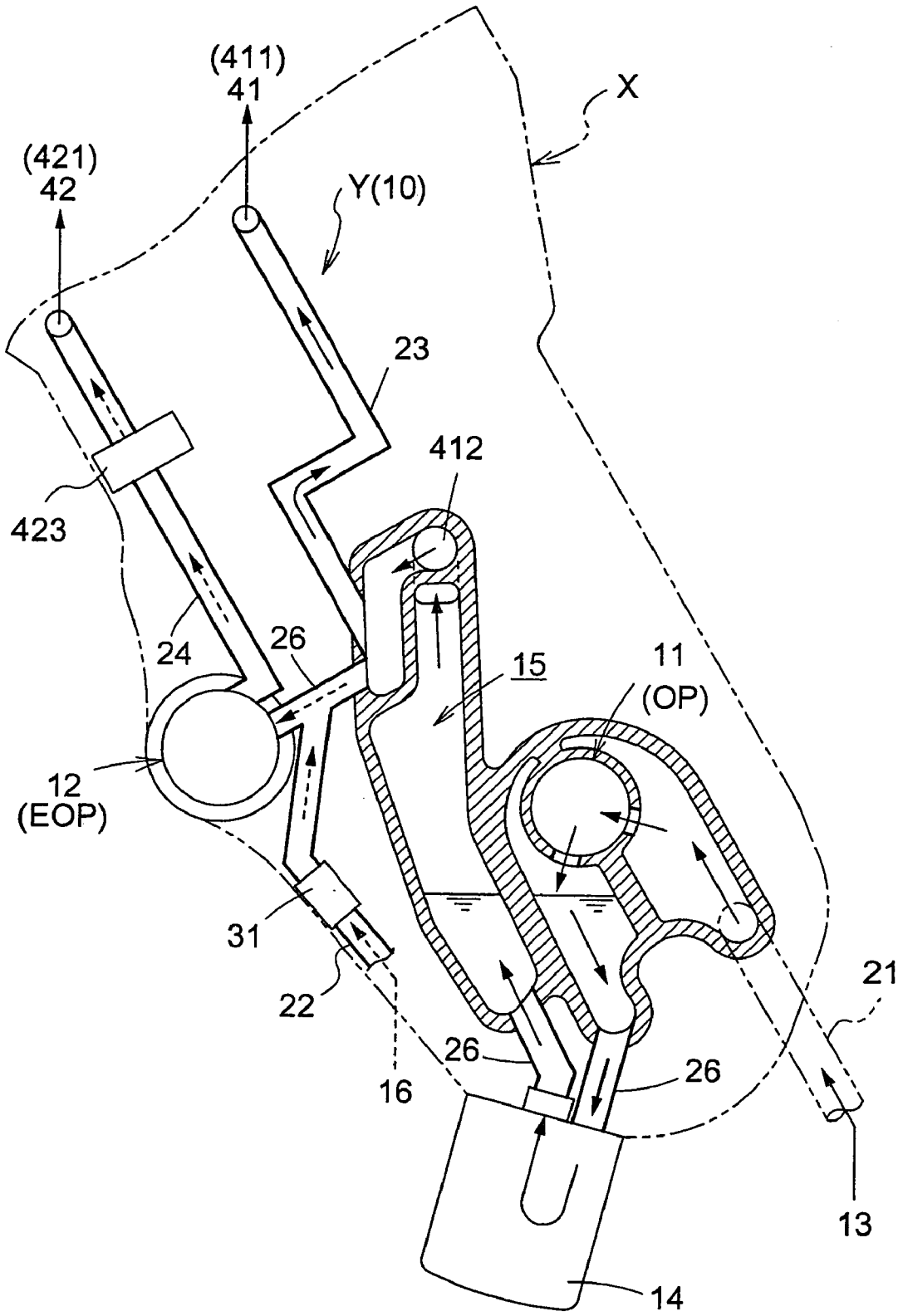
FIG. 3 is a side view of an oil supply apparatus according to a third embodiment.
Figure 7:
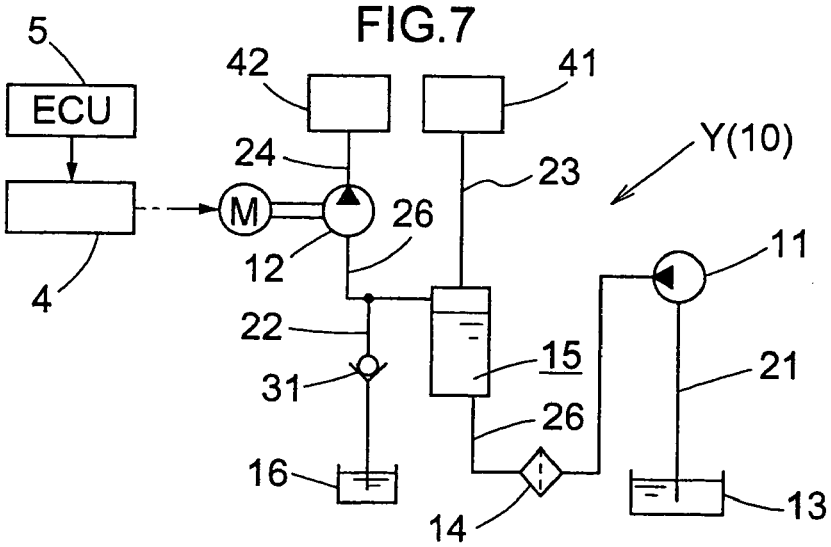
FIG. 7 is a schematic view of the oil supply apparatus according to the third embodiment.

FIGS. 3 and 7 show a modification of the first embodiment.

Here, the second oil reservoir 16 provided specifically for the second oil pump 12 is disposed below the second oil pump 12. The second oil reservoir 16 is formed independently of the oil holder 13. This makes it possible to reliably supply the oil to the second oil pump 12. The oil at the second oil reservoir 16 is supplied through the second oil passage 22 connected to the connection oil passage 26. The first valve 31 is disposed at the second oil passage 22.

As in the previous embodiment, the first valve 31 is, for example, a check valve. For example, when the engine is started, oil is supplied to the second oil pump 12 through the second oil passage 22 until oil is supplied from the first oil pump 11. When the pressure of the first oil pump 11 is increased, the oil is supplied to the second oil pump 12 by it rather than from the second oil passage 22. Here, the first valve 31 prevents reverse flow of the oil which has flown from the first oil pump 11 to the second oil reservoir 16.

FOURTH EMBODIMENT

Figure 4:
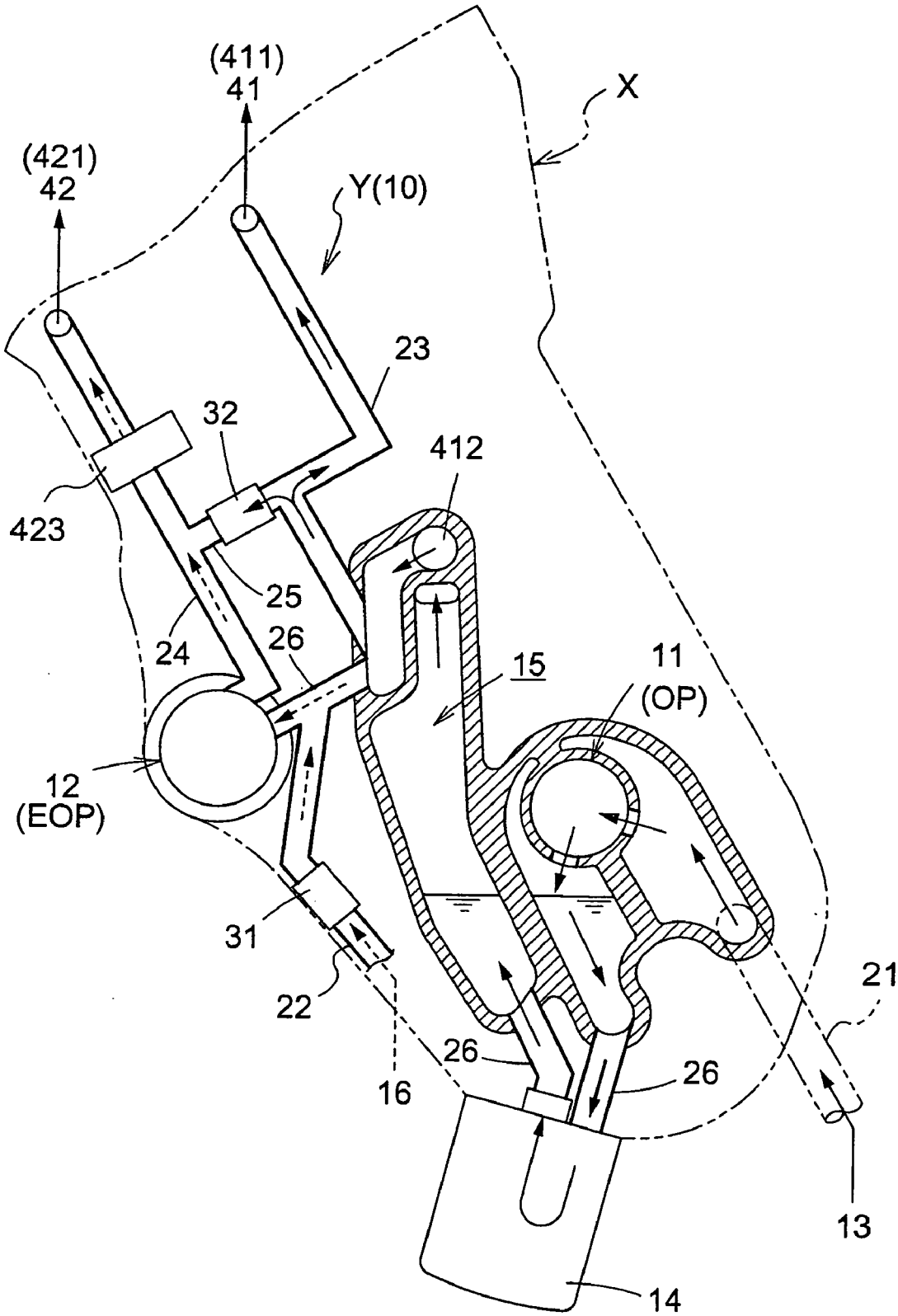
FIG. 4 is a side view of an oil supply apparatus according to a fourth embodiment.
Figure 8:
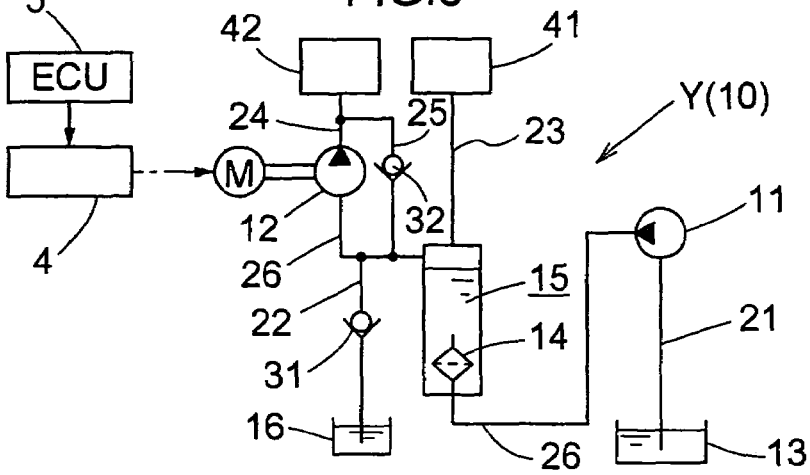
FIG. 8 is a schematic view of the oil supply apparatus according to the fourth embodiment.

FIGS. 4 and 8 show a modification of the second embodiment.

Here, the second oil reservoir 16 is disposed below the second oil pump 12. The second oil reservoir 16 is formed independently of the oil holder 13. This makes it possible to reliably supply the oil to the second oil pump 12. As in the third embodiment, the oil at the second oil reservoir 16 is supplied through the second oil passage 22 connected to the connection oil passage 26, and the first valve 31 is disposed in the second oil passage 22.

As in the third embodiment, the first valve 31 is also, for example, a check valve. The first valve 31 has a controlling function and a reverse flow prevention function as those mentioned above.

In the present embodiment, as shown in FIG. 8, the oil filter 14 is disposed in the connection oil passage 26, and forms the first oil reservoir 15. Ordinarily, a certain amount of oil is accumulated in the oil filter 14 regardless of whether the engine is running. Accordingly, by making use of this oil, the first oil reservoir 15 for supplying oil to the second oil pump 12 can be provided without considerably changing the structure of the engine, such as providing a space for the first oil reservoir 15 in the engine.

FIFTH EMBODIMENT

Figure 9:
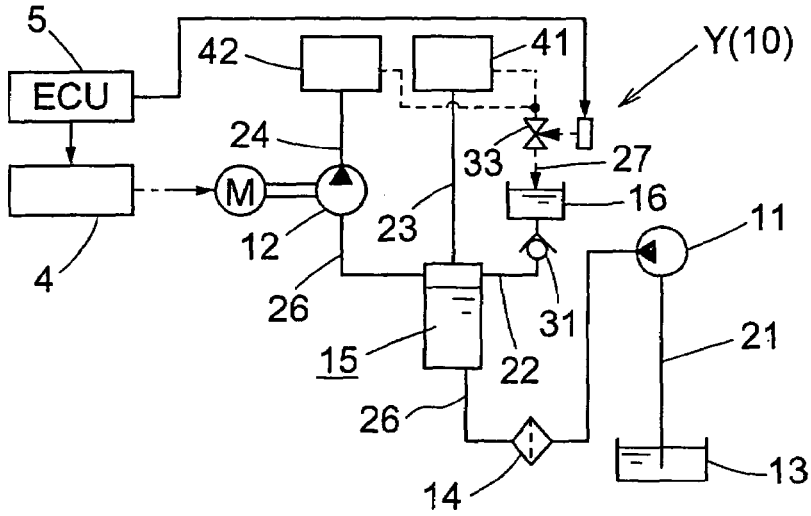
FIG. 9 is a schematic view of an oil supply apparatus according to a fifth embodiment.

As shown in FIG. 9, a reflux oil passage 27 for allowing oil to flow back from the first circulation section 41 or the second circulation section 42 may be connected to the first oil reservoir 15. More specifically, the oil flowing back from the first circulation section 41 or the second circulation section 42 is made to flow back to the second oil reservoir 16 through the reflux oil passage 27 in which a third valve 33 is disposed. From here, the oil returns to the first oil reservoir 15 through the first valve 31 and the second oil passage 22.

By virtue of such a structure, the oil temporarily supplied to the first circulation section 41 or the second circulation section 42 can be stored again in the first oil reservoir 15 through the reflux oil passage 27. During this time, the discharge pressure of the first oil pump 11 and the discharge pressure of the second oil pump 12 are maintained at a sufficient level, so that the oil is not prevented from being supplied to each part of the engine.

The third valve 33 may be, for example, a check valve or a control valve. Of these, the check valve makes it possible to simplify the oil supply apparatus. On the other hand, the control valve can properly control the quantity of flow of oil based on the driving state of the engine as described above.

SIXTH EMBODIMENT

Figure 10:
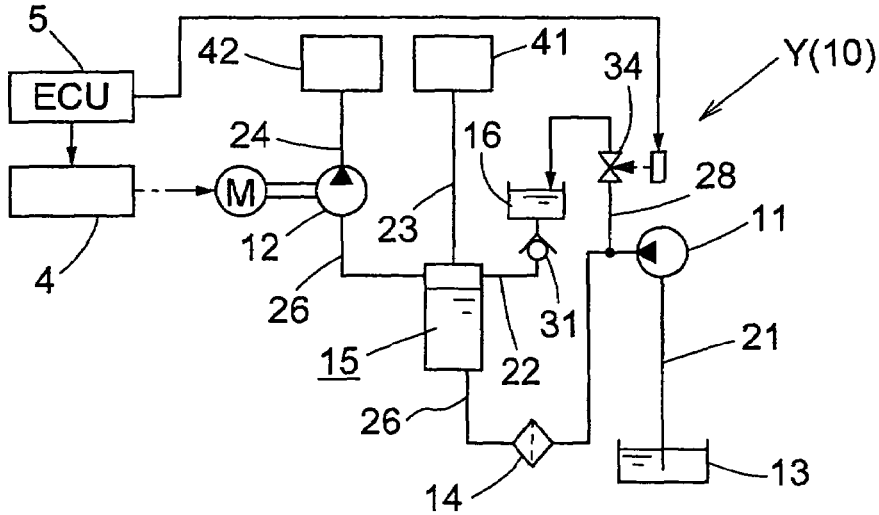
FIG. 10 is a schematic view of an oil supply apparatus according to a sixth embodiment.

With the oil supply apparatus of this embodiment, as shown in FIG. 10, oil discharged by the first oil pump 11 is also supplied to the first oil reservoir 15. In the oil supply apparatus of the present embodiment, a third supply oil passage 28 communicating with the second oil reservoir 16 branches off from a portion of the connection oil passage 26. This makes it possible for a portion of the oil for being supplied to the first oil reservoir 15 to be stored in the second oil reservoir 16 through the third supply oil passage 28. As a result, since oil can always be supplied to the first oil reservoir 15 from the second oil reservoir, even when only the second oil pump 12 is driven, a sufficient amount of oil can be supplied to the second oil pump 12.

A fourth valve 34 for controlling the circulation of oil to the second oil reservoir 16 is disposed in the third supply oil passage 28. The fourth valve 34 may be, for example, a check valve or a control valve. In particular, when a control valve is used, as shown in FIG. 10, for example, the opening and closing of the fourth valve 34 can be controlled by a controlling operation of the engine control unit (EPU) 5 so that a constant amount of oil is held at all times in the second oil reservoir 16.

SEVENTH EMBODIMENT

Figure 11:
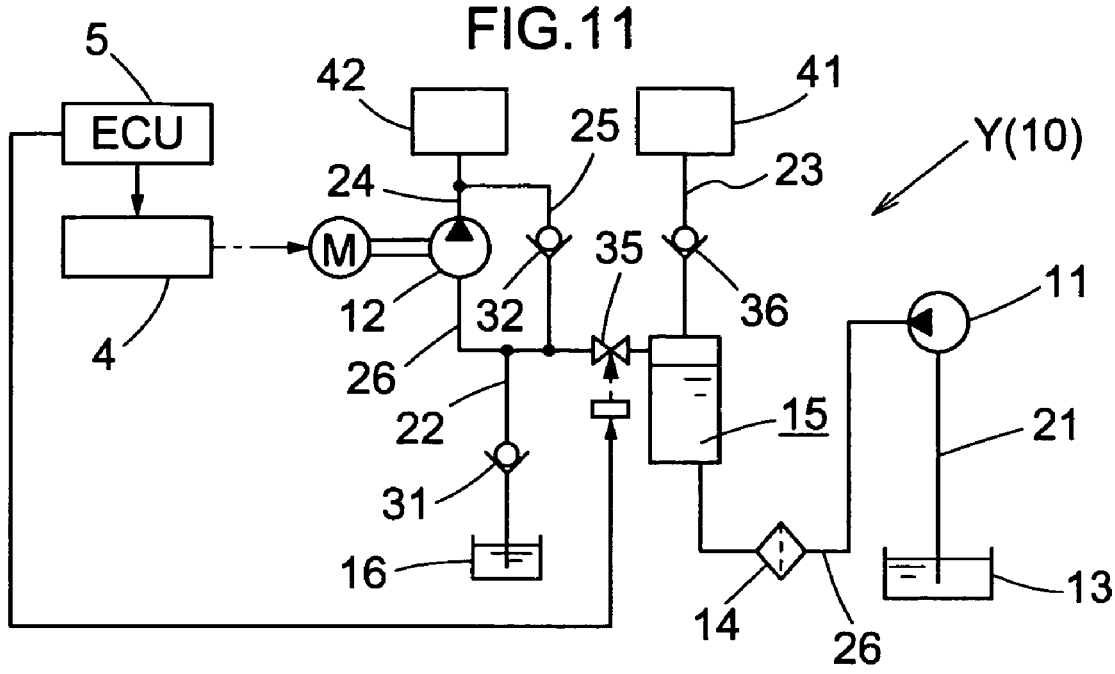
FIG. 11 is a schematic view of an oil supply apparatus according to a seventh embodiment.

FIG. 11 shows an example in which a third valve 35 for performing a controlling operation so that only oil from the second oil passage 22 is supplied to the second oil pump 12 is disposed at the connection oil passage 26 connecting the first oil pump 11 and the second oil pump 12.

In the present embodiment, the third valve 35 is disposed in the connection oil passage 26 so as to be situated downstream from the first oil reservoir 15. With this structure, when the second oil pump 12 is driven when, for example, the engine is started, the third valve 35 is closed in order for the second oil pump 12 to draw in oil only from the second oil reservoir 16 and the second oil passage 22.

In other words, since, immediately after the starting of the engine, the first oil pump 11 and the connection oil passage 26, disposed downstream from the first oil pump 11, are not filled with oil, a certain amount of air exists. Therefore, when the second oil pump 12 is driven immediately after starting the engine, it may draw in the air. And when the air is sent to a downstream circulation section (such as the second circulation section 42), problems of, for example, lubrication no longer being sufficiently performed and the rotation of the engine becoming irregular may occur.

To overcome such problems, as in this structure, with the third valve 35 for performing a controlling operation so that only oil from the second oil passage 22 is supplied to the second oil pump 12, and with the third valve 35 closed, it is possible to prevent the second oil pump 12 from drawing in the air and to, thus, prevent the air from entering the downstream second circulation section 42.

A seventh valve 36 for preventing reverse flow of oil to the first oil reservoir 15 is disposed in the first supply oil passage 23 communicating with the first circulation section 41 from the first oil reservoir 15. Even if air exists in the first supply oil passage 23, this structure can prevent the air from being drawn in by the second oil pump 12.

This makes it possible to effectively prevent the aforementioned problems from occurring in the second circulation section 42, the engine, etc.

The location of the third valve 35 is not limited to that described above. It may be disposed at any location as long as it can perform a controlling operation so as to allow only the oil from the second oil passage 22 to be supplied to the second oil pump 12.

The third valve 35 may be a control valve.

Here, the third valve 35, which is a control valve, is connected to the ECU 5, so that the opening and closing of the third valve 35 can be controlled by the ECU 5.

EIGHTH EMBODIMENT

Figure 12:
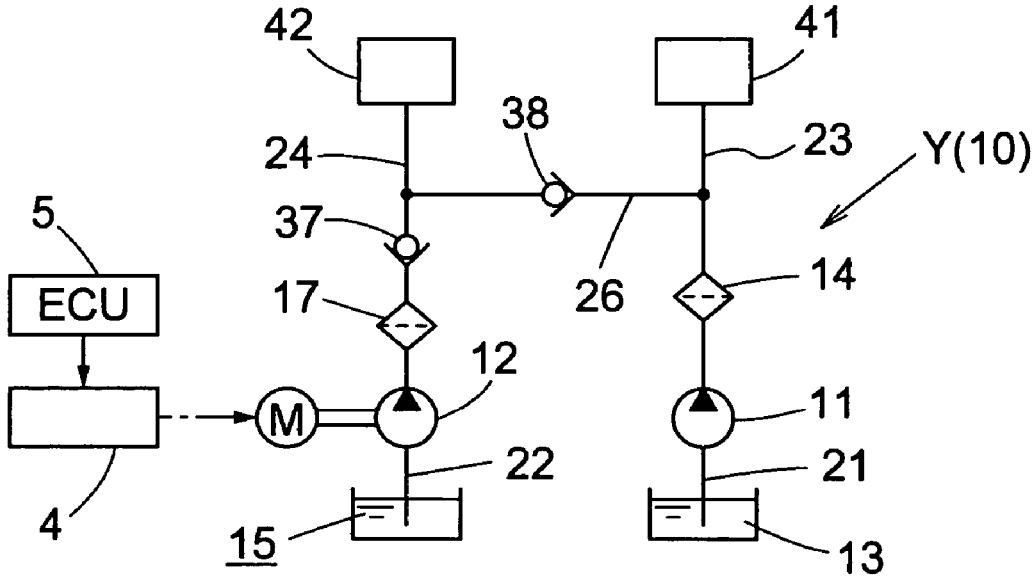
FIG. 12 is a schematic view of an oil supply apparatus according to an eighth embodiment.

In the previous embodiments, the first oil pump 11 and the second oil pump 12 are connected in series, whereas, in this embodiment, as shown in FIG. 12, the first oil pump 11 and the second oil pump 12 are connected in parallel, so that the oil pumps can be driven independently.

The first oil pump 11 is connected to the first oil passage 21 for drawing oil from the oil holder 13. The oil discharged from the first oil pump 11 passes through the oil filter 14. Then, a portion of this oil flows to the main gallery, and is supplied to the first circulation section 41, such as the cylinder head, through the first supply oil passage 23.

Another portion of the oil discharged from the first oil pump 11 is supplied to the second circulation section 42, such as the VVT, through the connection oil passage 26.

The oil filter 14 is disposed downstream from the first oil pump 11. A fifth valve 38 for controlling the circulation of oil to the second circulation section 42 is disposed in the connection oil passage 26.

The second oil pump 12 disposed in parallel with the first oil pump 11 draws in oil from the first oil reservoir 15 through the second oil passage 22.

The oil discharged from the second oil pump 12 is supplied to the second circulation section 42 through an oil filter 17 and the second supply oil passage 24. A sixth valve 37 for controlling the circulation of oil to the second circulation section 42 is disposed downstream from the second oil pump 12.

When utilizing the oil supply apparatus of the present embodiment, and when the engine is started, the second oil pump 12 is driven to supply oil to the second circulation section 42. In this case, since oil can be drawn in from the dedicated first oil reservoir 15, the oil is properly supplied to the second circulation section 42.

When the rotational speed of the engine stabilizes and the supply oil pressure generated by the first oil pump 11 becomes sufficiently high, the fifth valve 38 opens to supply oil from the first oil pump 11 to the second supply oil passage 24. When the ECU 5 detects this state, the driver 4 reduces or stops the driving of the second oil pump 12, so that the oil is efficiently supplied.

Accordingly, by providing the dedicated first oil reservoir 15 for supplying oil to the second oil pump 12 independently of the oil holder 13, the suction of oil by the first oil pump 11 and the suction of oil by the second oil pump 12 do not interfere with each other, so that the second oil pump 12 can draw in oil independently of the driving state of the first oil pump 11.

OTHER EMBODIMENTS

Ordinarily, the engine is covered with, for example, an engine cover, and the oil supply apparatus Y is disposed in the engine. The connection oil passage 26 and the first oil reservoir 15 may be integrally formed with such a cover member that is a portion of the engine.

For example, the first oil pump 11, the second oil pump 12, the connection oil passage 26, and the first oil reservoir 15 are integrally formed with the inner side of the cover member.

If these portions are disposed in substantially the same plane as in the disclosed structures, the oil passages connecting the portions can be made shorter. For example, the length of the connection oil passage 26 connecting the first oil pump 11 and the second oil pump 12 and the length of the second oil passage 22 connecting the first oil reservoir 15 and the second oil pump 12 can be made shorter. As a result, the oil can be quickly supplied, and loss of oil pressure occurring, for example, when the engine is started can be reduced. In addition, the engine can be made compact, and, when mounting the connection oil passage 26 and the first oil reservoir 15 in the engine, only the cover member integrally formed with these portions needs to be mounted, so that the number of man-hours for assembling the engine can be reduced.

Although, in the embodiment described above, a cover member is taken as an example of an engine member, the present invention is not limited thereto, so that the portions may be integrally formed with a different engine member.

The present invention is not limited to the above-described embodiments, so that the structure of each portion may be varied as required as long as similar operational advantages are provided.

INDUSTRIAL APPLICABILITY

The engine oil supply apparatus according to the present invention is widely applicable to, for example, a general automobile engine or a stationary engine for power generation. The present invention is applicable to any engine as long as the engine is equipped with a first oil pump, driven by a crank shaft, and an oil feeding second oil pump in order to supply oil to a part of the engine.

The invention claimed is:

1. An engine oil supply apparatus comprising:

a first oil pump driven in synchronism with a crankshaft and drawing oil through a first oil passage from an oil holder holding oil;

a second oil pump connected in series with the first oil pump through a connection oil passage and driven independently of the first oil pump;

a first supply oil passage for supplying the oil to a first circulation section from the first oil pump; and a second supply oil passage for supplying oil to a second circulation section from the second oil pump, a first oil reservoir which holds oil to be supplied to the second oil pump, the first oil reservoir being shielded from the outside, and is provided independently of the oil holder.

2. The engine oil supply apparatus according to claim 1, wherein oil is supplied from the oil holder or a second oil reservoir to the second oil pump through a second oil passage of the connection oil passage, and wherein a first valve for controlling circulation of the oil to the second oil pump is disposed in the second oil passage.

3. The engine oil supply apparatus according to claim 1, wherein the first valve is either a check valve or a control valve.

4. The engine oil supply apparatus according to claim 1, wherein a third oil passage for supplying oil to the second supply oil passage by bypassing the second oil pump is provided, and a second valve for controlling circulation of oil to the second supply oil passage is disposed in the third oil passage.

5. The engine oil supply apparatus according to claim 4, wherein the second valve is either a check valve or a control valve.

6. The engine oil supply apparatus according to claim 2, wherein a reflux oil passage for returning oil from the first circulation section or the second circulation section is connected to the first oil reservoir.

7. The engine oil supply apparatus according to claim 1, wherein a third supply oil passage for supplying the oil discharged from the first oil pump is connected to the second oil reservoir.

8. The engine oil supply apparatus according to claim 1, wherein an oil filter is disposed in the connection oil passage, and wherein the oil filter functions as the first oil reservoir.

9. The engine oil supply apparatus according to claim 1, wherein the connection oil passage and the first oil reservoir are integrally formed with a member of the engine.

10. The engine oil supply apparatus according to claim 2, wherein a third valve for performing a controlling operation so that only oil from the second oil passage can be supplied to the second oil pump is disposed in the connection oil passage.

11. An engine oil supply apparatus comprising:

a first oil pump driven in synchronism with a crankshaft and drawing oil through a first oil passage from an oil holder holding oil;

a second oil pump provided in parallel with the first oil pump and driven independently of the first oil pump;

a first supply oil passage for supplying oil to a first circulation section from the first oil pump; and a second supply oil passage for supplying oil to a second circulation section from the second oil pump, wherein oil is supplied to the second oil pump through a second oil passage, and the second oil passage is disposed independently of a first oil passage for supplying oil to the first oil pump, and wherein a fifth valve for controlling circulation of oil to the second circulation section is disposed in a connection oil passage connecting the first oil pump and the second oil pump.

* * * * *